United States Patent [19]

Shimizu et al.

[11] Patent Number: 4,719,130

[45] Date of Patent: Jan. 12, 1988

[54] METHOD FOR PRODUCING A TONER-FIXER ROLL

[75] Inventors: Koji Shimizu; Haruki Wakita; Mitsuo Hamada, all of Chiba, Japan

[73] Assignee: Toray Silicone Co., Ltd., Tokyo, Japan

[21] Appl. No.: 871,935

[22] Filed: Jun. 9, 1986

[30] Foreign Application Priority Data

Jun. 17, 1985 [JP] Japan ..... 60-131601

[51] Int. Cl.[4] ..... B05D 3/02

[52] U.S. Cl. ..... 427/380; 29/132; 427/355; 427/387

[58] Field of Search ..... 427/387, 379, 380, 355; 29/132

[56] References Cited

U.S. PATENT DOCUMENTS 3,677,993 6/1972 Stevenson, II ..... 427/387 X 3,848,305 11/1974 Jachimiak ..... 427/387 X 4,074,001 2/1978 Imai et al. ..... 427/387 X 4,404,042 9/1983 Okada et al. ..... 427/387 X

*Primary Examiner*—Thurman K. Page

*Attorney, Agent, or Firm*—Edward C. Elliott

[57] ABSTRACT

Because the present invention produces a toner-fixing roll by forming, directly or indirectly, a layer of thermal stabilizer-containing cured silicone rubber on the circumferential surface of a core and by then heating the cured silicone rubber layer at 270° C. to 400° C. for 15 minutes to 24 hours, said toner-fixing roll has excellent releasability with regard to fused toner without the use of silicone oil. Due to this, the silicone rubber-coated roll produced by the method of the present invention is appropriately employed as a toner-fixing roll in dry electrophotographic devices, that is, it is suitable for the heat-fixing roll or pressure roll and particularly for the heat-fixing roll.

5 Claims, No Drawings

METHOD FOR PRODUCING A TONER-FIXER ROLL

BACKGROUND OF THE INVENTION

1. Field of the Invention

The present invention describes a method for producing a toner-fixing roll. More specifically, the present invention describes a method for producing an electrophotographic toner-fixing roll which fixes the toner powder image in dry electrophotography to the image-supporting material, such as paper, etc., using heat and pressure.

2. Background Information

Silicone rubber-coated rolls are the standard example of electrophotographic toner-fixing rolls known from the prior art. However, because simple silicone rubber-coated rolls do not exhibit a satisfactory releasability for fused toner, the following have appeared: toner-fixing rolls, and particularly heat-fixing rolls, in which the silicone rubber-coated roll has been immersed in hot silicone oil for an extended period of time for impregnation with silicone oil; toner-fixing rolls, and particularly heat-fixing rolls, obtained by vulcanizing a silicone oil-containing rubber composition; and toner-fixing rolls, and particularly heat-fixing rolls, wherein a thin film of silicone oil is supplied to the surface of the silicone rubber-coated roll during use.

However, with regard to tone-fixing rolls, and particularly heat-fixing rolls, which have been impregnated with silicone oil, as well as silicone oil-containing toner-fixing rolls, and particularly silicone oil-containing heat-fixing rolls, the silicone rubber is swollen by the action of the silicone oil. Also, the silicone oil may be entirely consumed in a short time and the releasability of the silicone rubber will then decline and it will shrink. On the other hand, supplying silicone oil to a toner-fixing roll, and particularly to a heat-fixing roll, requires a silicone oil supply device, thus necessitating a larger apparatus.

SUMMARY OF THE INVENTION

A method for producing a toner-fixer roll is characterized in that a layer of thermal stabilizer-containing cured silicone rubber is formed on the surface of the circumference of a core. The silicone rubber is formed directly on the core or indirectly by forming over an intermediate layer which is directly on the core. The cured silicone rubber is heated for a period of from 15 minutes to 24 hours at a temperature of from 270° C. to 400° C. to produce a surface which has improved release to toner powder without the use of replaceable release oil.

An object of the present invention is to eliminate the problems residing in the technology of the prior art as described above; that is, the goal of the present invention is to provide a method for producing a toner-fixing roll, and particularly a heat-fixing roll, which will have an excellent toner releasability even without the use of silicone oil.

DESCRIPTION OF THE INVENTION

This invention is a method for producing a toner-fixing roll, comprising (A) forming a layer of a thermal stabilizer-containing silicone rubber either directly or indirectly on the circumference of a core, then (B) curing said silicone rubber, then (C) heating said cured silicone rubber for 15 minutes to 24 hours at from 270° C. to 400° C. in an air flow.

By way of explanation, the core is generally made of metal and will be a shaft or cylinder. A cylindrical core may contain a heat source in its interior. The layer of thermal stabilizer-containing cured silicone rubber is formed directly or indirectly on the circumferential surface of the core. As used herein, direct formation of the layer means that a layer of thermal stabilizer-containing silicone rubber is formed on the circumferential surface of the core without any other intervening layer. Indirect formation means that the layer of thermal stabilizer-containing cured silicone rubber is formed on the circumferential surface of the core through the intermediary of some other layer, for example, a layer of some other type of cured rubber or a layer of cured silicone rubber which lacks thermal stabilizer. Since this invention necessarily employs heating at quite high temperatures, the layer of thermal stabilizer-containing cured silicone rubber is preferably formed directly on the circumferential surface of the core. In any case, a thin layer of a suitable primer is advantageously coated on the circumferential surface of the core in order to improve bonding. However, this does not necessarily apply when the layer of thermal stabilizer-containing cured silicone rubber is a heat-shrinkable tube. The thickness of the layer of thermal stabilizer-containing cured silicone rubber is not particularly restricted. When the layer is too thin, the contours of the toner image become unclear. On the other hand, when this layer is too thick, the silicone rubber is uselessly consumed. Due to this, the thickness of the silicone rubber layer of a heat-fixing roll is preferably 0.25 to 1.5 mm and the thickness of the silicone rubber layer of a pressure roll is 3 to 10 mm. The hardness of the cured silicone rubber layer should be 10 to 70. When the hardness value is too high, the contours of the toner image become unclear. When the hardness value is too low, the toner cannot be satisfactorily fixed to paper, etc. A pressure roll can be designed with a bilayer coating: an inner cured silicone sponge layer and an outer layer of the usual cured silicone rubber.

Silicone rubber compositions which may be used to form the cured silicone rubber layer include milling-type silicone rubber compositions and liquid silicone rubber compositions. Milling-type silicone rubber compositions encompass addition-curing types and organoperoxide-vulcanizing types. The liquid silicone rubber compositions encompass addition-curing types, organoperoxide-vulcanizing types and condensation-curing types. Typical milling-type silicone rubber compositions are the organoperoxide-vulcanizing types and typical liquid silicone rubber compositions are the addition-curing types.

The organoperoxide-vulcanizing types are typically principally composed of a diorganopolysiloxane gum or vinyl-terminated liquid diorganopolysiloxane, along with filler and a catalytic quantity of an organoperoxide. Addition-curing types are typically principally composed of a vinyl-terminated diorganopolysiloxane gum or liquid, organohydrogenpolysiloxane, filler and a catalytic quantity of a platinum-type catalyst. Condensation-curing types are typically principally composed of a silanol-terminated diorganopolysiloxane liquid, a silane or siloxane which contains an average of 3 to 4 silicon-bonded hydrolyzable groups in each molecule, filler and a catalytic quantity of the organotin salt of an organocarboxylic acid.

All of these types of curable silicone rubber compositions must contain a thermal stabilizer which can prevent degradation of the cured silicone rubber layer during the heat treatment. Examples of the thermal stabilizers are metal compounds such as ferric oxide, ferroferric oxide, ferric hydroxide, cerium oxide, cerium hydroxide, lanthanum oxide, fumed titanium dioxide, iron naphthenate, cerium naphthenate and cerium dimethylpolysilanolate, individually or as mixtures of 2 or more of these metal compounds. The content of thermal stabilizer is 1 to 30 weight percent for metal oxides, 0.1 to 7 weight percent for metal hydroxides and 0.05 to 5 weight percent in other cases.

The layer of thermal stabilizer-containing cured silicone rubber is directly formed on the circumferential surface of the core by forming a layer of the thermal stabilizer-containing curable silicone rubber composition on the core's circumferential surface, which is optionally coated with primer, followed by maintenance at room or elevated temperature in order to cure the silicone rubber composition.

The layer of curable silicone rubber composition can be formed on the core's circumferential surface by methods such as compression molding, liquid injection molding, casting molding, coating or spraying, but compression molding and liquid injection molding are preferably used from the standpoints of dimensional accuracy and speed of operation. The molding method is appropriately selected by taking into consideration the viscosity and curing mechanism of the silicone rubber composition used.

Organoperoxide-vulcanizing silicone rubber compositions are generally cured by primary vulcanization at 110° to 200° C. for 50 to 30 minutes and by a subsequent secondary vulcanization at 200° to 250° C. for 2 to 10 hours. However, secondary vulcanization is not necessarily required when the organoperoxide used is an alkyl peroxide.

Addition-curing silicone rubber compositions are generally cured at room temperature to about 180° C. for 1 to 48 hours and condensation-curing silicone rubber compositions are generally cured at room temperature to 150° C. for 10 minutes to 10 days. It is obvious that, even for silicone rubber compositions with the same curing mechanism, the curing temperatures and curing times will vary with the type and quantity of curing catalyst used, the quantity of functional groups and the molding method.

In an alternative method, the layer of thermal stabilizer-containing cured silicone rubber is directly formed on the core's circumferential surface by inserting the core into a tube of heat-shrinkable, thermal stabilizer-containing silicone rubber. The inside diameter of the tube should be slightly larger than the outside diameter of the core. The silicone rubber tube is then heated in order to shrink the inside diameter of the tube to a size equal to or less than the outside diameter of the core.

In the indirect formation of the layer of thermal stabilizer-containing cured silicone rubber on the circumferential surface of the core, a layer of another type of rubber composition, or of a curable silicone rubber composition lacking thermal stabilizer, is first formed on the core's circumferential surface, the layer of thermal stabilizer-containing curable silicone rubber composition is then formed on the above layer and both layers are then cured simultaneously.

The layer of thermal stabilizer-containing cured silicone rubber, which has been formed directly or indirectly on the circumferential surface of the core as above, is heated at 270° C. to 400° C. for 15 minutes to 24 hours and preferably at 300° C. to 370° C. for 20 minutes to 16 hours.

This heat treatment can be conducted in a heated atmosphere or in a metal mold, but it is preferably conducted under a hot air flow to obtain an improved toner releasability.

Because the layer of thermal stabilizer-containing cured silicone rubber is not necessarily flat or smooth, it should be polished smooth using a grinder before or after the heat treatment.

EXAMPLES

The present invention will be explained using examples of execution. "Parts" in examples means "weight parts". The viscosity, peeling force using pressure-sensitive tape and toner releasability are all measured at 25° C. Toner releasability from the cured silicone rubber layer is measured as follows.

A 2.1 mm thick sheet of cured silicone rubber is prepared from the curable silicone rubber composition used to produce the toner-fixing roll. One of the surfaces of the sheet is polished with a whetstone (roughness, 10 $\mu$m), followed by heat treatment. Two test pieces (width, 30 mm; length, 150 mm; thickness, 2 mm) are cut from this sheet. These 2 test pieces are overlapped so that the polished surfaces overlap by 100 mm along the length direction. A 0.1 mm thickness of MT toner from Minolta Camera Co., Ltd. is inserted between the overlapped portions and the test pieces are then inserted into an electrically heated press at 180° C. and allowed to stand for 20 minutes in order to fuse the toner. The test pieces are then removed from the press and cooled.

The test pieces, now bonded to each other by the toner, are placed in a tensile tester. The non-overlapped areas of the test pieces are inserted in the grippers, followed by pulling the overlap along the length direction at a rate of 200 mm/min. The maximum value of the tensile stress is used as the index of toner releasability.

EXAMPLE 1

First, 100 parts of a silicone rubber composition, composed of 71.4 weight percent dimethylsiloxane-methylvinylsiloxane copolymer gum (dimethylsiloxane/methylvinylsiloxane molar ratio=99.3:0.7), 25.0 weight percent fumed silica (specific surface, 200 $m^2/g$) and 3.6 weight percent $\alpha\omega$-dihydroxydimethylsiloxane oligomer, was combined and kneaded to homogeneity with 13.5 parts finely divided ferric oxide and 1.0 part 2,5-dimethyl-2,5-bis(di-t-butyl peroxy)hexane using a two-roll mill. This mixture was taken off as a sheet and then wrapped around an aluminum metal core (outside diameter, 50 mm; length, 300 mm) for toner-fixing roll applications. The metal core was coated beforehand with a silicone primer and dried.

The aluminum metal core wrapped with the silicone rubber composition sheet was set in a metal mold which was then inserted between the platens (180° C.) of an electrically heated press for 15 minutes. The metal mold was removed from the electrically heated press and then opened, the silicone rubber-coated roll (silicone rubber thickness, 1.1 mm) was removed from the metal mold and then allowed to stand for a secondary vulcanization in a hot air-circulation oven at 200° C. for 4 hours, then removed from the oven and cooled. The silicone rubber surface of this silicone rubber-coated roll was polished with a whetstone (roughness, 1.0 μm) to obtain a silicone rubber thickness of 1.0 mm. The polished silicone rubber-coated roll was allowed to stand in a hot air-circulation oven at 360° C. for 30 minutes, then removed and cooled. A polyester pressure-sensitive tape (31B from Nitto Electric Industries Co., Ltd.) was pressed on the silicone rubber surface of the heat-fixing roll manufactured as above. When the pressure on the tape was released, the tape peeled off almost immediately.

In a comparison example, a heat-fixing roll coated with cured silicone rubber was manufactured from the same curable silicone rubber composition as above, and by the same method as above, with the exception that the heat treatment at 360° C. was omitted. When the polyester pressure-sensitive tape (31B from Nitto Electric Industries Co., Ltd.) was pressed onto the silicone rubber surface of this roll, the tape did not peel off when the pressure was released. Peeling the tape required a maximum tensile stress of 50 g/4 cm.

The above-mentioned curable silicone composition was converted into a cured silicone rubber sheet, one surface was polished and the sheet was then heated at 360° C. for 30 minutes. The toner releasability was examined before and after the heat treatment. The curing conditions were as follows: primary vulcanization was a compression molding at 180° C. for 15 minutes and secondary vulcanization was a hot-air vulcanization at 200° C. for 24 hours. The maximum tensile stress was 10 g/4 cm after heat treatment at 360° C. and was 35 g/4 cm before heat treatment at 360° C. This demonstrated that heating at 360° C. significantly improved toner releasability.

In another comparison example, a cured silicone rubber sheet was produced by the method used in the example, but omitting the addition of ferric oxide. The toner releasability was examined after heating at 360° C. for 30 minutes: the maximum tensile stress was 45 g/4 cm. Thus, when the ferric oxide was absent, toner releasability significantly deteriorated. This can be attributed to degradation of the silicone rubber in the heat treatment at 360° C. in the absence of ferric oxide.

EXAMPLE 2

First, 100 parts of a liquid silicone rubber composition, composed of 55 weight percent vinyl-terminated dimethylpolysiloxane with a viscosity of 1000 centipoise, 17 weight percent fumed silica with a specific surface of 200 $m^2/g$ and hydrophobicized with hexamethyldisilazane, and 28 weight percent quartz powder with an average particle size of 5 μm, was combined and mixed to homogeneity with 0.62 parts methylhydrogenpolysiloxane (10 centipoise), 13.5 parts finely divided ferric oxide, 0.27 parts finely divided cerium oxide, 0.003 parts chloroplatinic acid, and 0.05 parts methylbutynol.

An aluminum metal core (outside diameter, 50 mm; length, 300 mm) for heat-fixing roll applications was coated with a silicone primer, dried and then inserted in a metal mold which was subsequently inserted between the platens (150° C.) of an electrically heated press. It was preheated for 10 minutes. Then a silicone rubber composition was injected into the interior of the metal mold using an injector, followed by standing at 150° C. for 5 minutes. The metal mold was removed from the electrically heated press, opened and a roll was removed which consisted of the aluminum metal core coated on its circumferential surface with a 1.1 mm thick layer of cured silicone rubber.

The silicone rubber surface of the roll was polished with a whetstone (roughness, 10 μm) to give a silicone rubber thickness of 1.0 mm. The roll was then allowed to stand in a hot air-circulation oven at 360° C. for 30 minutes, removed from the oven and cooled.

Polyester pressure-sensitive tape (31B from Nitto Electric Industries Co., Ltd.) was pressed onto the silicone rubber surface of the heat-fixing roll manufactured above. When the pressure was released, the tape peeled off almost immediately.

In a comparison example, a heat-fixing roll coated with cured silicone rubber was manufactured from the same curable silicone rubber composition as above, by the same method as above, but without conducting the heat treatment at 360° C. Polyester pressure-sensitive tape (31B from Nitto Electric Industries Co., Ltd.) was pressed on the silicone rubber surface of the roll: when the pressure was released, the tape did not peel off. The maximum tensile stress required to peel the tape was 30 g/4 cm.

A cured silicone rubber sheet was manufactured from the above curable silicone rubber composition, one of its surfaces was polished and it was then heated at 360° C. for 30 minutes. Toner releasability was measured before and after the heat treatment. The curing conditions were compression molding at 150° C. for 5 minutes. The maximum tensile stress was 5 g/4 cm after heat treatment at 360° C. and 30 g/4 cm before heat treatment at 360° C. This shows that the heat treatment at 360° C. significantly improved toner releasability.

In a comparison example, a cured silicone rubber sheet was produced by the method for the example, but without the addition of ferric oxide and cerium oxide. It was heated at 360° C. for 30 minutes in order to examine the toner releasability after the heat treatment. The maximum tensile stress was 60 g/4 cm. The heat treatment at 360° C. in the absence of thermal stabilizer significantly reduced toner releasability. This may be attributed to degradation of the silicone rubber.

EXAMPLE 3

A silicone rubber-coated heat-fixing roll and cured silicone rubber sheet were produced by the methods described in Example 2, but modifying the heat-treatment conditions to Example 2 to 300° C. for 8 hours. The pressure-sensitive tape peelability and toner releasability were both examined: the pressure-sensitive tape peelability was nearly equal to that of Example 2 and, with regard to toner releasability, the maximum tensile stress was 7 g/4 cm.

EXAMPLE 4

A silicone rubber-coated heat-fixing roll and a cured silicone rubber sheet were produced by the methods described in Example 1, but using 0.5 parts cerium hydroxide as the thermal stabilizer instead of that used in Example 1. The pressure-sensitive tape peelability and toner releasability were both examined: the pressure-sensitive tape peelability was almost identical to that of Example 1 and, with regard to toner releasability, the maximum tensile stress was 7 g/4 cm.

That which is claimed is:

1. A method for producing a toner-fixing roll, comprising (A) forming a layer of silicone rubber, containing from 1 to 30 weight percent thermal stabilizer selected from the group consisting of ferric oxide, cerium oxide, and cerium hydroxide, either directly or indirectly on the circumference of a core, then (B) curing said silicone rubber, then (C) heating said cured silicone rubber for 20 minutes to 16 hours at from 300° C. to 370° C. in an air flow.

2. The method of claim 1 wherein the silicone rubber is a silicone rubber composition having silica filler and an organoperoxide catalyst.

3. The method of claim 1 wherein the silicone rubber is a silicone rubber composition having silica filler and an addition-curing catalyst.

4. The method of claim 3 in which the addition-curing catalyst is platinum.

5. A method for producing a toner-fixing roll, consisting essentially of (A) forming a layer of silicone rubber, having silica filler and a catalyst selected from the group consisting of organoperoxide and platinum, containing from 1 to 30 weight percent thermal stabilizer selected from the group consisting of ferric oxide, cerium oxide, and cerium hydroxide, either directly or indirectly on the circumference of a core, then (B) curing said silicone rubber, then (C) grinding the cured silicone rubber to a smooth finish, then (D) heating said cured and ground silicone rubber roll for 20 minutes to 16 hours at a temperature of from 300° C. to 370° C. in an air flow at normal pressure.

* * * * *